US005762012A

United States Patent [19]

Kawamura et al.

[11] Patent Number: 5,762,012

[45] Date of Patent: Jun. 9, 1998

[54] SEWING MACHINE WITH THREAD EXCHANGE DEVICE

[75] Inventors: Yoshimi Kawamura, Anjo; Moriya Ochi, Toyota, both of Japan

[73] Assignee: Aisin Seiki Kabushiki Kaisha, Kariya, Japan

[21] Appl. No.: 806,681

[22] Filed: Feb. 26, 1997

[30] Foreign Application Priority Data

Feb. 29, 1996 [JP] Japan ..... 8-71174

[51] Int. Cl.[6] ..... D05B 55/16

[52] U.S. Cl. ..... 112/163; 112/221

[58] Field of Search ..... 112/277, 302, 112/100, 163, 167, 223, 225, 98

[56] References Cited

U.S. PATENT DOCUMENTS

| | | | |
|---|---|---|---|
| 4,075,958 | 2/1978 | Sacchetti | 112/163 |
| 4,276,838 | 7/1981 | Bolldorf | 112/221 |
| 4,473,018 | 9/1984 | Shimoda et al. | 112/163 |
| 4,524,703 | 6/1985 | Willenbacher | 112/221 X |
| 5,390,613 | 2/1995 | Shibata | 112/163 X |

FOREIGN PATENT DOCUMENTS

| | | |
|---|---|---|
| 3-62828 | 9/1991 | Japan . |

*Primary Examiner*—Ismael Izaguirre

*Attorney, Agent, or Firm*—Burns, Doane, Swecker & Mathis, LLP

[57] ABSTRACT

A sewing machine which includes a main shaft motor for driving a main shaft; a needle bar for moving up and down by rotation of the main shaft motor; a thread exchanging mechanism, having a swinging member swingable by rotation of the main shaft motor, for exchanging a thread by moving a thread barrel having an opening through which a thread is passed, from a standby position to an exchange position; and a controller for controlling the rotation of the main shaft motor.

16 Claims, 25 Drawing Sheets

SEWING MACHINE WITH THREAD EXCHANGE DEVICE

BACKGROUND OF THE INVENTION

1. Field of the Invention

The present invention relates to a sewing machine comprising a thread exchange device including a thread exchanging mechanism, having swinging members that are swung by rotation of a main shaft motor, for exchanging a thread by moving a thread barrel having an opening through which a thread is passed, from a standby position to an exchange position.

2. Description of the Prior Art

A conventional sewing machine (Japanese examined patent application No. HEI 3-62828) replaces a needle stud by controlling the positional relation between a reciprocating carriage R and a magazine M using a horizontal air cylinder H for horizontal movements and a vertical air cylinder V for vertical movements, as shown in FIG. 24. A thread is passed through a hole A of a thread guide finger F and passed through an eye of a needle N held by a needle holder T connected to a needle bar B, as shown in FIGS. 24 and 25.

Since the aforementioned conventional sewing machine replaces a needle stud by controlling the positional relation between the reciprocating carriage R and the magazine M using the horizontal air cylinder H for horizontal movements and the vertical air cylinder V for vertical movements as shown in FIG. 24, the conventional sewing machine has problems of a complicated apparatus construction, a large number of component parts, and high costs.

The conventional sewing machine also has problems in that thread exchange is cumbersome since a thread is passed through the hole A of the thread guide finger F and passed through the eye of the needle N held by the needle holder T connected to the needle bar B as shown in FIGS. 24 and 25.

SUMMARY OF THE INVENTION

It is a primary object to provide a sewing machine to be easy and reliable in a thread exchange.

It is an object to provide a sewing machine of a simple construction.

It is another object to reduce a number of component parts and to reduce costs in sewing machine.

It is further object to provide a sewing machine under a technical idea of exchanging a thread by moving a thread barrel having an opening through which a thread is passed, between a standby position and an exchange position under control of swing of a swinging member accomplished by controlling rotation of a main shaft motor.

It is a yet further object to provide a sewing machine which comprises a main shaft motor for driving a main shaft; a needle bar for moving up and down by rotation of the main shaft motor; a thread exchanging mechanism, having a swinging member swingable by rotation of the main shaft motor, for exchanging a thread by moving a thread barrel having an opening through which a thread is passed, from a standby position to an exchange position; and a controller for controlling the rotation of the main shaft motor.

It is a yet further object to provide a sewing machine wherein the swinging member comprises a first holding member for positioning the thread barrel in the exchange position and for enabling the swinging member to swing in a direction toward the standby position; and a second holding member for positioning the thread barrel in the standby position and for enabling the swinging member to swing in a direction toward the exchange position.

It is another object to provide a sewing machine wherein the first holding member is connected to a rotating member driven by the main shaft motor, so that the first holding member is swung by a rotation of the main shaft motor; and the second holding member is connected to an operating motor so that the second holding member is swung by a rotation of the operating motor.

It is a further object to provide a sewing machine which comprises a shifting mechanism including: a shift frame movable in a lateral direction with respect to a machine frame of the sewing machine, the shift frame having a plurality of the second holding members arranged thereon in such a manner as to allow the second holding members to swing; and a shift motor for moving and positioning the shift frame relatively to the machine frame of the sewing machine.

It is a still further object to provide a sewing machine which comprises a needle holder disposed in a lower portion of the shift frame and extending in a lateral direction with respect to the machine frame of the sewing machine, the needle holder having a plurality of needle stud holding portions for holding needle studs formed under each of the second holding members.

It is a yet further object to provide a sewing machine wherein the needle stud holding portions are formed by recesses which are arranged at a predetermined interval in a longitudinal direction of the needle holder formed by a plate member and the needle stud holding portions are provided with an arrangement of leaf springs for elastically supporting the needle studs.

It is a yet further object to provide a sewing machine wherein the needle bar is movable up and down along a guide by a connecting rod one of whose ends is swingably engaged with a portion of the rotating member, so that interchange of the needle studs is enabled by upward and downward movements of the needle bar along the guide and lateral movements of the needle stud holding portions.

The sewing machine according to the present invention replaces a thread by swinging the needle bar up and down under control of the main shaft motor that drives the main shaft based on the controller, and by moving the thread barrel having the opening through which a thread is passed, between the standby position and the exchange position based on swing of the swinging member caused by rotation of the main shaft motor.

The sewing machine according to the present invention interchanges thread barrels by the first holding member, which constitutes the swinging member, positioning the thread barrel in the exchange position and swinging in a direction to the standby position for receiving the thread barrel held in the standby position, and by the second holding members, which constitute the swinging member, positioning the thread barrels in the standby position and swinging in a direction to the exchange position for passing the thread barrel held in the standby position.

The sewing machine according to the present invention interchanges thread barrels by the first holding member, which is connected to the rotating member driven by the main shaft motor, swinging in the direction to the standby position and the direction to the exchange position in accordance with rotation of the main shaft motor, and by the second holding members, connected to the operating motor, swinging in the exchange position and the direction to the direction to the standby position in accordance with rotation of the operating motor.

The sewing machine according to the present invention selects the thread barrel holding a thread to be used, by the shift motor, which constitutes the shifting mechanism, moving the shift frame, which carries an arrangement of the swingable second holding members, in a lateral direction with respect to the machine frame of the sewing machine.

In the sewing machine according to the present invention the needle holder disposed in a lower portion of the shift frame and extending in a lateral direction with respect to the machine frame of the sewing machine is provided with the plural needle stud holding portions for holding needle studs formed under each of the second holding members. When the thread to be used for sewing is selected by a lateral shift of the shift frame, the needle stud connected with the thread barrel holding that thread is selected.

In the sewing machine according to the present invention the needle stud holding portions, formed by the recesses arranged at a predetermined interval in the longitudinal direction of the needle holder formed by a plate member, is provided with an arrangement of the leaf springs for elastically support the needle studs.

The sewing machine according to the present invention removes from the needle bar the needle stud to be replaced and fits to the needle bar the needle stud selected as described above, by vertical movements along the guide of the needle bar, which is movable up and down along the guide by transmission of the connecting rod swingably held at one end to a portion of the rotating member, and by lateral movements of the needle stud holding portions.

Since the sewing machine of the present invention swings the swinging member in accordance with rotation of the main shaft motor to move the thread barrel having a hole through which a thread passed, between the standby position and the exchange position, for thread exchange, the sewing machine advantageously ensures and facilitates thread exchange.

Since the sewing machine of the present invention operates the first holding member to position the thread barrel in the exchange position and to swing in the direction to the standby position for receiving the thread barrel held in the standby position, and operates the second holding members to position the thread barrels in the standby position and to swing in the direction to the exchange position for passing the thread barrel held in the standby position, in order to replace the thread barrel holding a thread to be replaced, the sewing machine advantageously enhances the reliability and easiness in thread exchange, allows a simple apparatus construction, and reduces the number of component parts and costs.

Since the sewing machine of the present invention replaces a thread by the first holding member swinging in the direction to the standby position and the direction to the exchange position in accordance with rotations of the main shaft motor and the rotating member, and by the second holding members, connected to the operating motor, swinging in the direction to the exchange position and the direction to the standby position in accordance with rotation of the operating motor, the sewing machine advantageously accomplishes well-timed and smooth thread exchange.

Since the sewing machine of the present invention selects the thread barrel holding a thread to be used, by the shift motor moving the shift frame having an arrangement of the second holding members, in a lateral direction with respect to the machine frame of the sewing machine, the sewing machine advantageously enables selection of a thread to be used for sewing.

Since in the sewing machine of the present invention the needle holder extending laterally in a lower portion of the shift frame is provided with the plural needle stud holding portions for holding the needle studs downward, corresponding to the second holding members, the sewing machine advantageously makes it possible to select the needle stud connected with the thread barrel holding a thread for the next sewing when that thread is selected by a lateral shift of the shift frame.

Since in the sewing machine of the present invention the needle stud holding portions formed by recesses arranged at fixed intervals in the direction of the length of the needle holder formed of a plate member are provided with the plate springs for elastically holding the needle studs, the sewing machine advantageously ensures the firm holding of the needle studs and facilitates attachment and detachment thereof.

Since the sewing machine of the present invention removes from the needle bar the needle stud to be replaced, and fits to the needle bar the needle stud selected for sewing, by moving the needle bar up and down along the guide and shifting the needle stud holding portions laterally, the sewing machine advantageously accomplishes thread exchange by simple operation performed by a simple apparatus construction, and reduces the number of component parts and costs.

DETAILED DESCRIPTION OF THE PREFERRED EMBODIMENT

Embodiment of the present invention will be described with reference to the drawings.

(Embodiment)

Figure 1:
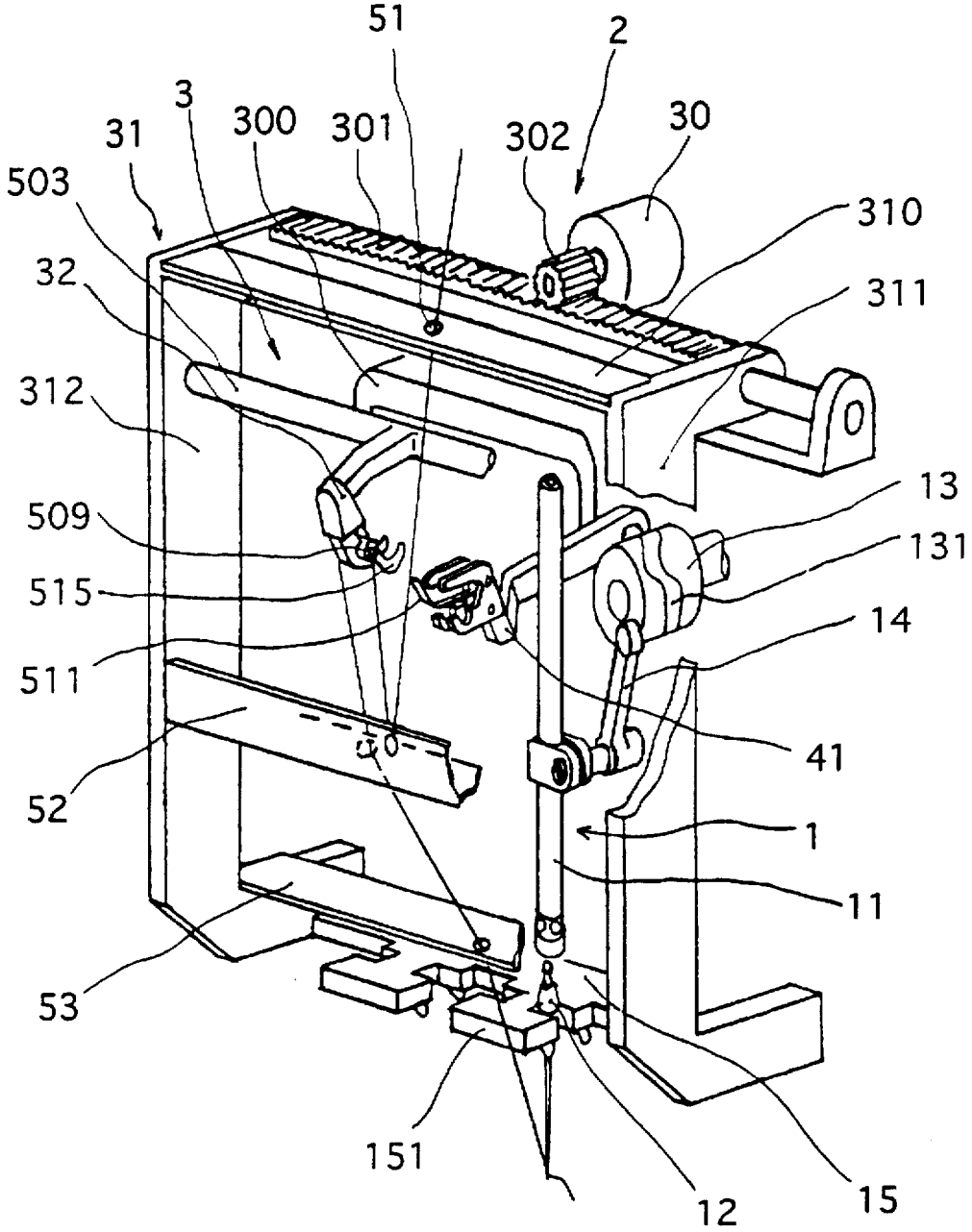
FIG. 1 is a perspective view of significant portions of a sewing machine according to an embodiment of the present invention.
Figure 2:
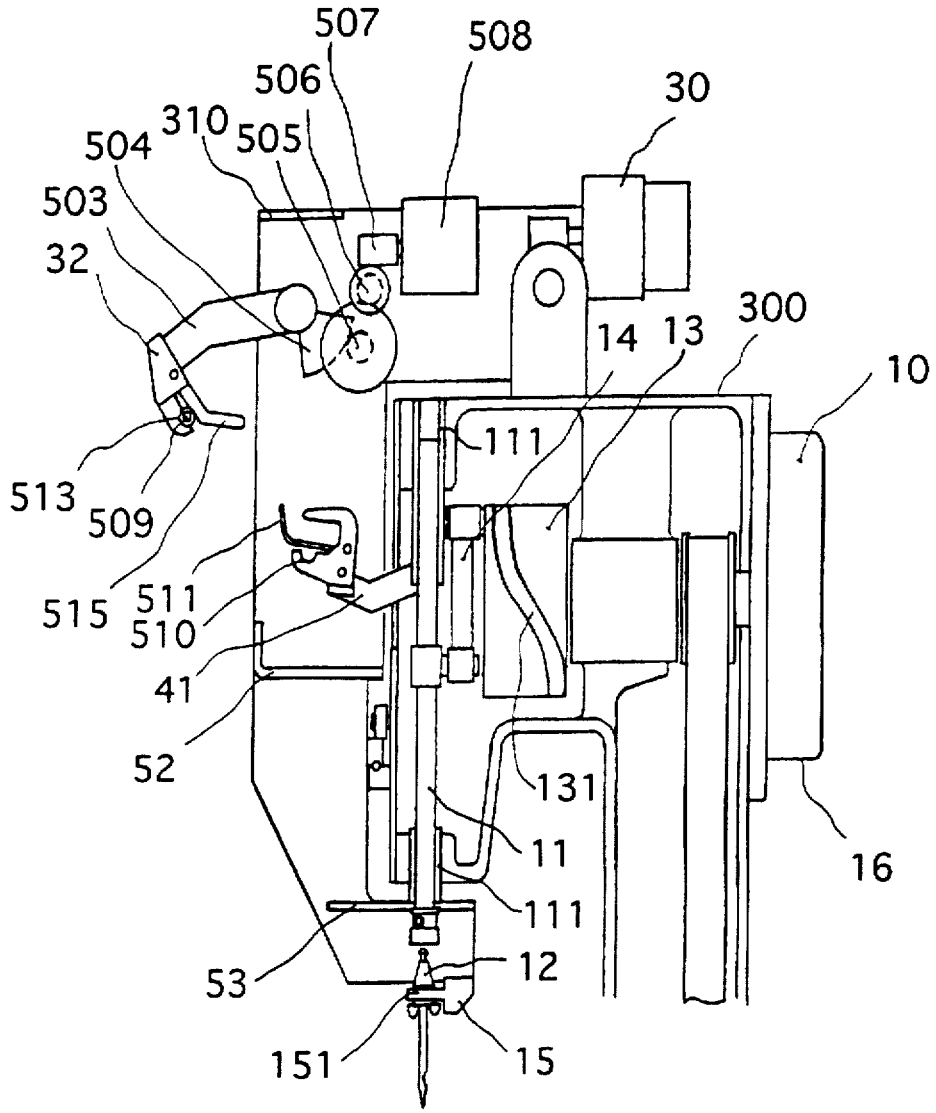
FIG. 2 is a side view of significant portions, illustrating the frame-side construction of the sewing machine according to the embodiment.
Figure 3:
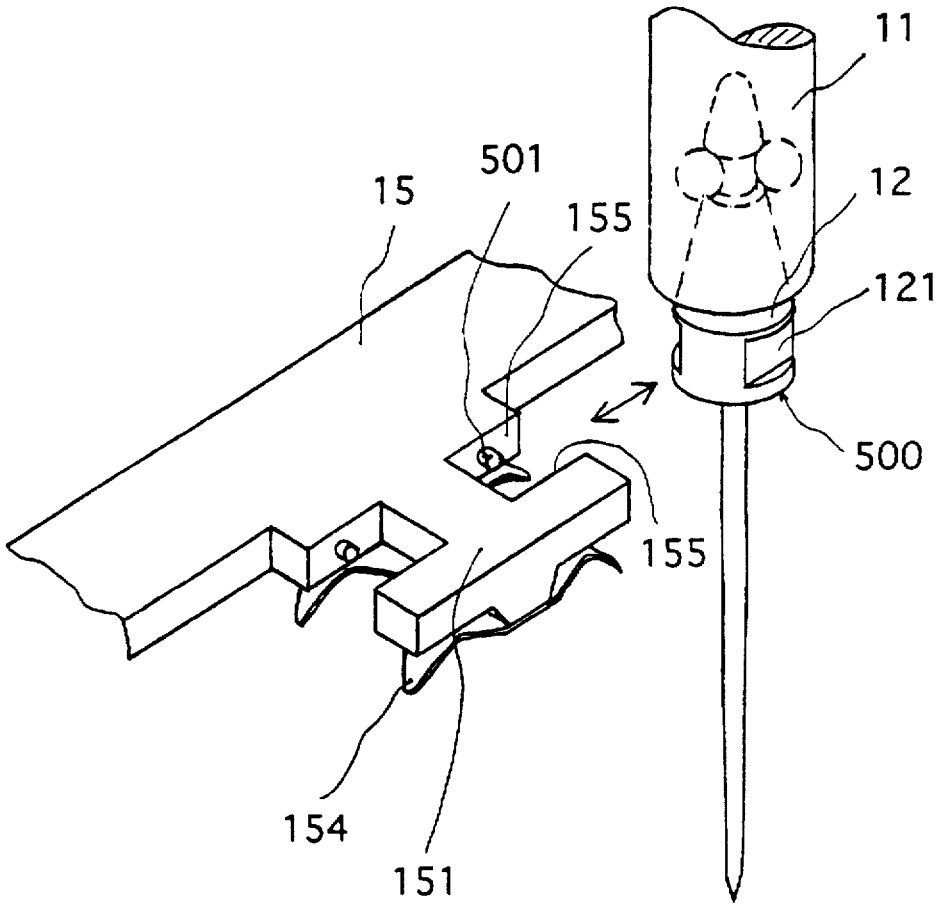
FIG. 3 is a partial perspective view of a needle stud holding mechanism of the sewing machine according to the embodiment.
Figure 4:
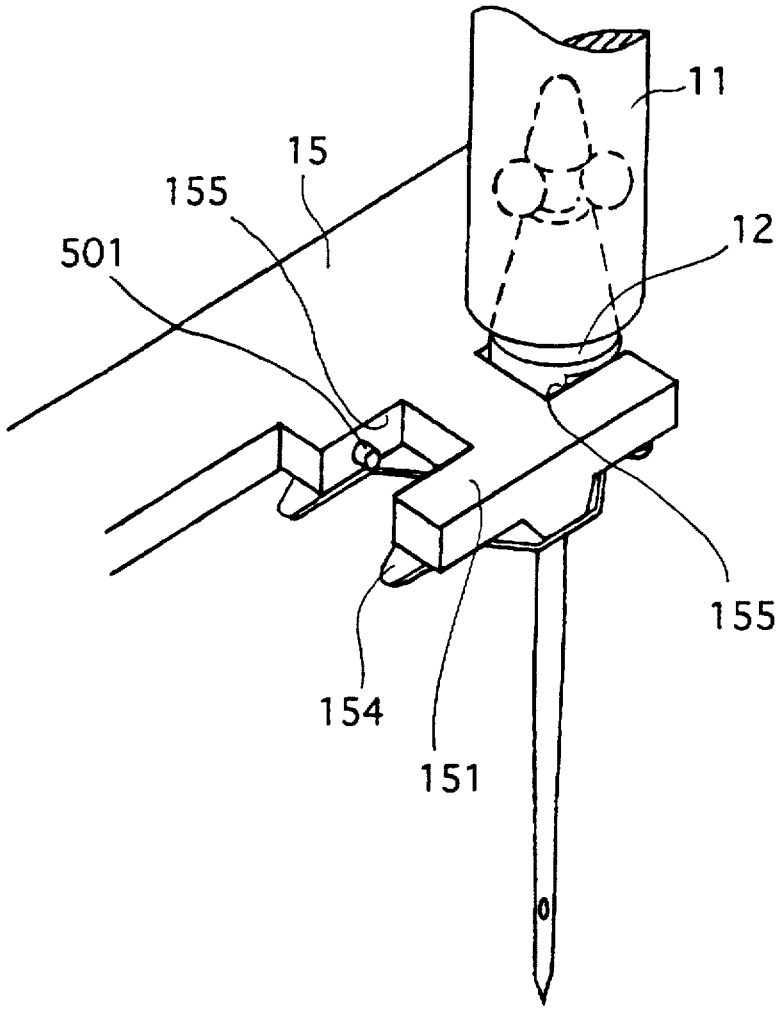
FIG. 4 is a partial perspective view of the sewing machine according to the embodiment, illustrating a state where a needle stud is being replaced.
Figure 5:
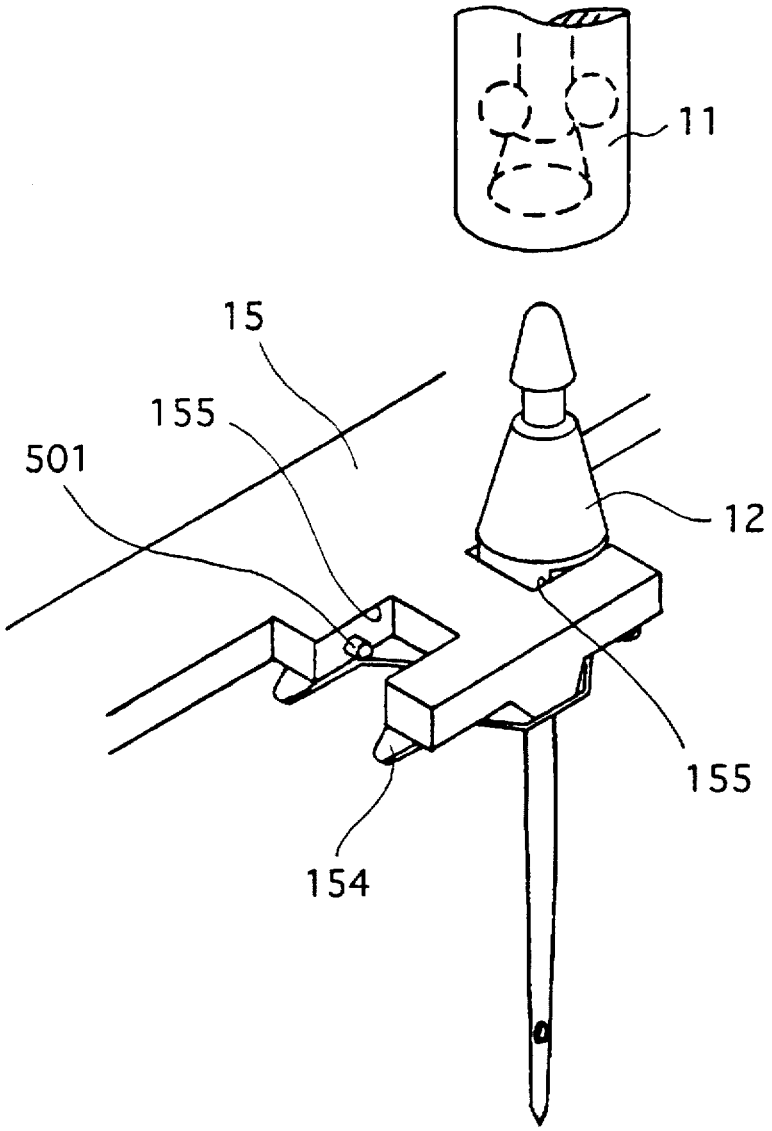
FIG. 5 is a partial perspective view of the sewing machine according to the embodiment, illustrating the state where a needle stud is being replaced.
Figure 6:
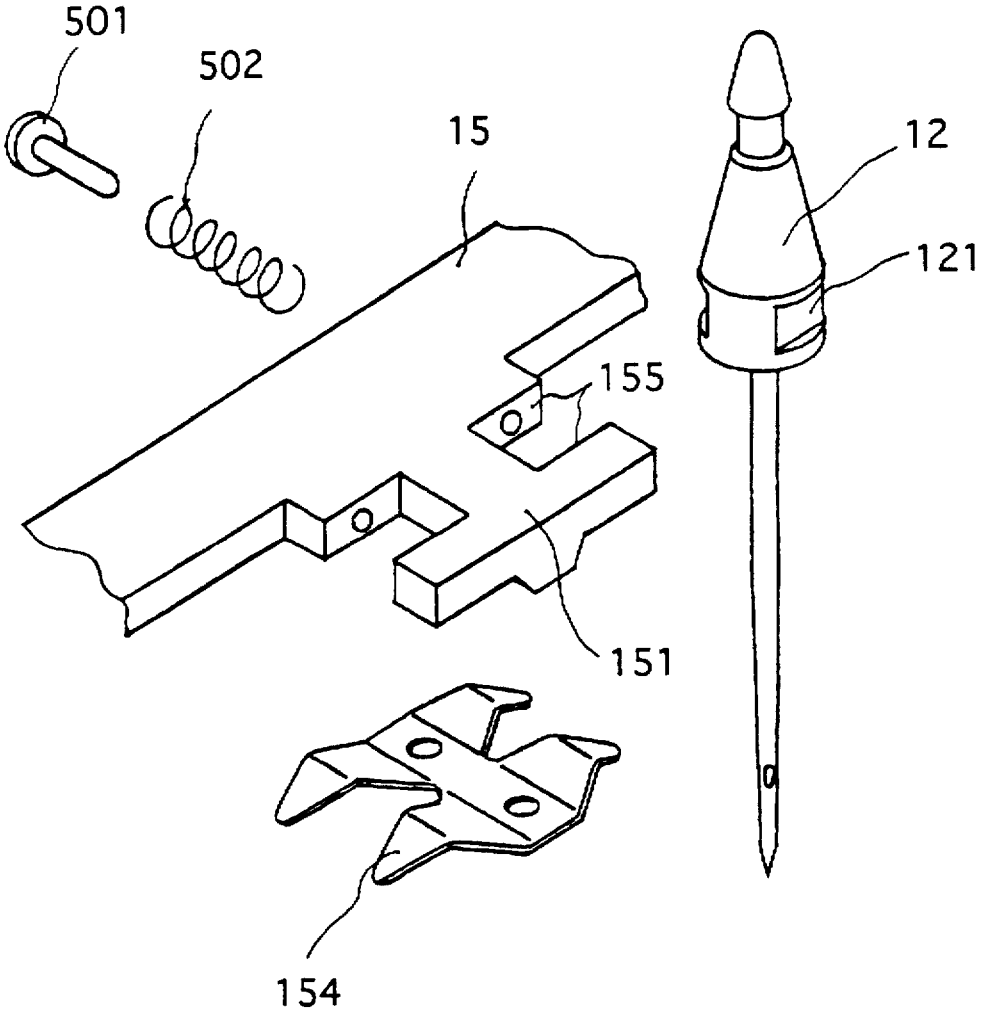
FIG. 6 is an exploded perspective view of the needle stud holding mechanism and the needle stud of the sewing machine according to the embodiment.

A sewing machine according to an embodiment comprises a needle exchanging device 1 enabling exchange of a needle stud 12 fitted to a needle bar 11, a shifting mechanism 2 enabling a needle thread for sewing to be selected from a plurality of needle threads, and a thread exchanging mechanism 3 enabling an unneeded needle thread to be replaced with a needle thread to be used for sewing, as shown in FIGS. 1 and 2.

The needle exchanging device 1 comprises, as shown in FIGS. 1 and 2, a main shaft motor 10 for driving a main shaft, a rotating member 13 driven by the main shaft motor 10, a connecting rod 14 one of whose ends is engaged with a portion of the rotating member 13, the needle bar 11 connected with the other end of the connecting rod 14 and capable of moving up and down along a linear guide 111, a needle holder 15 that has holding portions 151 for receiving a needle stud 12 to be replaced and holding a needle stud 12 to be fitted and that positions the needle studs 12 below the needle bar 11, and a controller 16 for controlling the main shaft motor 10 so as to move the needle bar 11 upward for passing the needle stud 12 to be interchanged, and so as to move the needle bar 11 downward for fitting the needle stud 12 to be set.

The needle holder 15 is formed by a plate member extending in a lateral direction with respect to a machine frame 300 of the sewing machine and connecting between lower portions of right and left perpendicular members 311, 312 that constitute the shift frame 31, as shown in FIG. 1.

Referring to FIGS. 3 through 6, the holding portion 151 has U-shaped holding grooves 155 each of which opens in a lateral direction with respect to the machine frame 300 of the sewing machine for holding the needle stud 12 by abutting against recesses 121 formed in a lower outside wall of the needle stud 12. The holding portion 151 is further provided with an approximately H-shaped leaf spring 154 that abuts against a bottom face 500 of the needle stud 12 while pushing the needle stud 12 upward, and pins 501 and coil springs 502 that are inserted in the needle holder 15 so that each pin 501 may engage with one of the recess of a needle stud 12 while pressing against the recess. The H-shaped leaf spring having a corrugated cross section is attached to an lower surface of the H-shaped plate member.

The shifting mechanism 2, as shown in FIG. 1, comprises the shift frame 31 formed by a generally rectangular frame 310 and movable in a lateral direction with respect to the machine frame 300 of the sewing machine, and a step motor or geared motor 30 for moving or shifting the shift frame 31 by using a rack 301 and a pinion 302 to position the shift frame 31 relatively to an operating position of the machine frame 300 of the sewing machine.

As shown in FIG. 1, holders 32, provided as second holding members for holding a required number of thread barrels 509, corresponding to the number of needle thread required (FIG. 1 shows only one thread barrel as a representative), in a standby position (sewing position), are arranged at predetermined intervals on a thread barrel holder 503 disposed swingably and extending horizontally between the perpendicular members 311 and 312 of the shift frame 31. As shown in FIG. 2, the holders 32 and the thread barrel holder 503 are constructed so that when positioned relatively to the operating position of the machine frame 300 of the sewing machine, the holders 32 and the thread barrel holder 503 can be swung by an operating motor 508, such as a step motor or a geared motor, that is drivingly connected thereto by a first gear 504 fixed to the thread barrel holder 503, a second gear 504 meshing with the first gear 504, and a third gear 506 and a fourth gear 507.

The thread exchanging mechanism 3, as shown in FIGS. 1 and 2, FIGS. 7 through 16 and FIG. 17, and FIGS. 18 through 23, comprises a tubular thread barrel 509 for holding a sewing thread; a yoke 41, provided as a first holding member, which is swingably supported and has a groove 510 for holding the thread barrel 509 and a spring 511 for holding the thread barrel 509 while abutting against the thread barrel 509; and a plurality of holders 32, provided as second holding members, each of which is swingably supported and has a groove 513 for holding the thread barrel 509 when the sewing thread is to be replaced and a claw part 515 swingably supported to abut against and hold the thread barrel 509 by a spring 514 urged clockwise. The thread exchanging mechanism 3 has a function of transferring the thread barrel 509 holding a sewing thread from the yoke 41 to one of the holders 32 or the other way around, for exchange of a sewing thread.

One end of the yoke 41 is engaged with a cam groove 131 formed on an outer peripheral wall of the rotating member 13 driven by the main shaft motor 10 as shown in FIG. 1. The cam groove 131 causes the yoke 41 to swing about a fulcrum synchronously with rotation of the main shaft.

The press spring 511 is urged counterclockwise so that when the thread barrel 509 is transferred from the holder 32 to the yoke 41, the press spring 511 will contact and guide in the thread barrel 509 and press the thread barrel 509 into the groove 510. The press spring 511 is supported on a shaft of the yoke 41 in such a manner as to abut against an outer peripheral surface of an intermediate portion of the thread barrel 509 with respect to its length.

The claw part 515 is urged clockwise by the spring 514 and supported swingably on a shaft of the holder 32 in such a manner that when there is difficulty in transfer of the thread barrel 509 from the yoke 41 to the holder 32, the claw part 515 will guide in the thread barrel 509 while contacting outer peripheral faces of opposite end portions of the thread barrel 509 with respect to its length and, then, press the thread barrel 509 into the groove 513 formed on the holder 32, as shown in FIGS. 11 through 23.

The thus-constructed sewing machine according to the embodiment performs needle exchange by the needle exchanging device 1 moving the needle bar 11 upward for transferring the needle stud 12 to be replaced, and downward for fitting the needle stud 12 to be set. The needle bar 11 is movable up and down along the linear guide 111, by transmission of the connecting rod 14 swingably supported, at its one end, on a portion of the rotating member 13 driven by the main shaft motor 10. Thus the needle bar 11 is moved up and down in accordance with rotation of the rotating member 13, by controlling the main shaft motor 10 using the controller 16.

The shifting mechanism 2 moves or shifts the needle holder 15 supported by the shift frame 31 for holding the needle studs 12, between the needle exchange position and the needle standby position (sewing position) that are defined in a lateral direction with respect to the machine frame 300 of the sewing machine, by using the shift motor 30, such as a step motor or a geared motor, and the rack 301 and the pinion 302, as shown in FIGS. 1 and 2.

Figure 7:
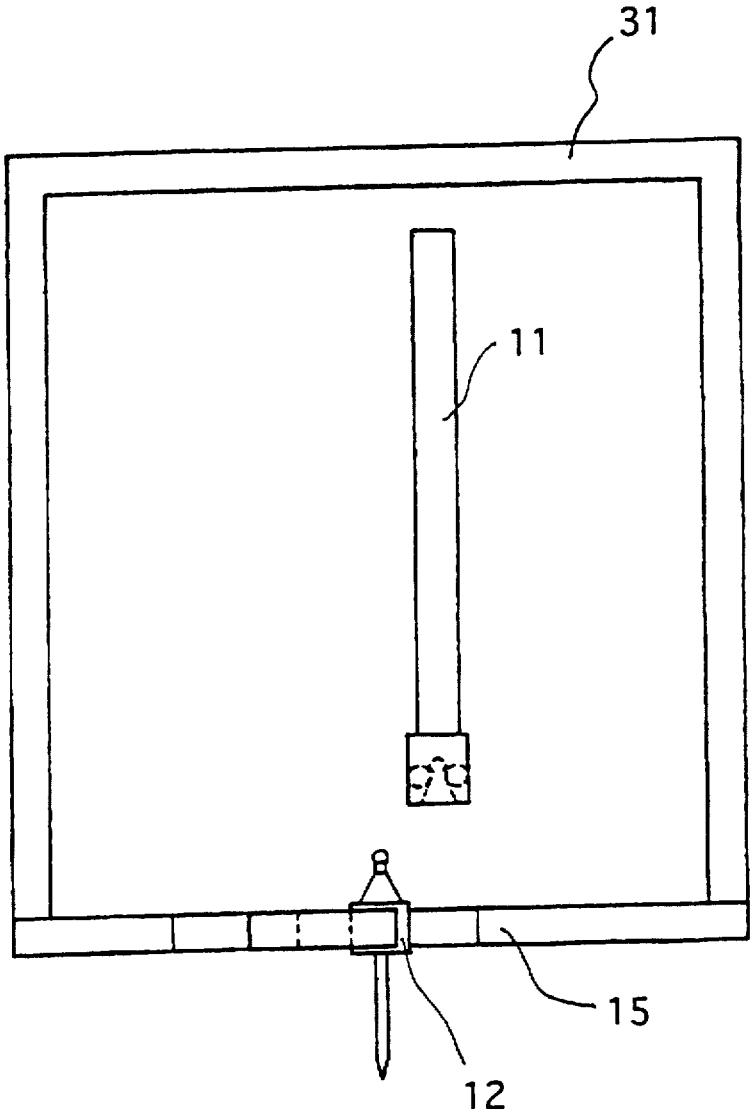
FIG. 7 is a front view illustrating exchange of the needle stud performed by the sewing machine according to the embodiment.

FIG. 7 illustrates a standby position in the first step of the needle exchanging operation, where a thread not in use for sewing is held. (FIG. 7 shows only one thread as a representative.)

Figure 8:
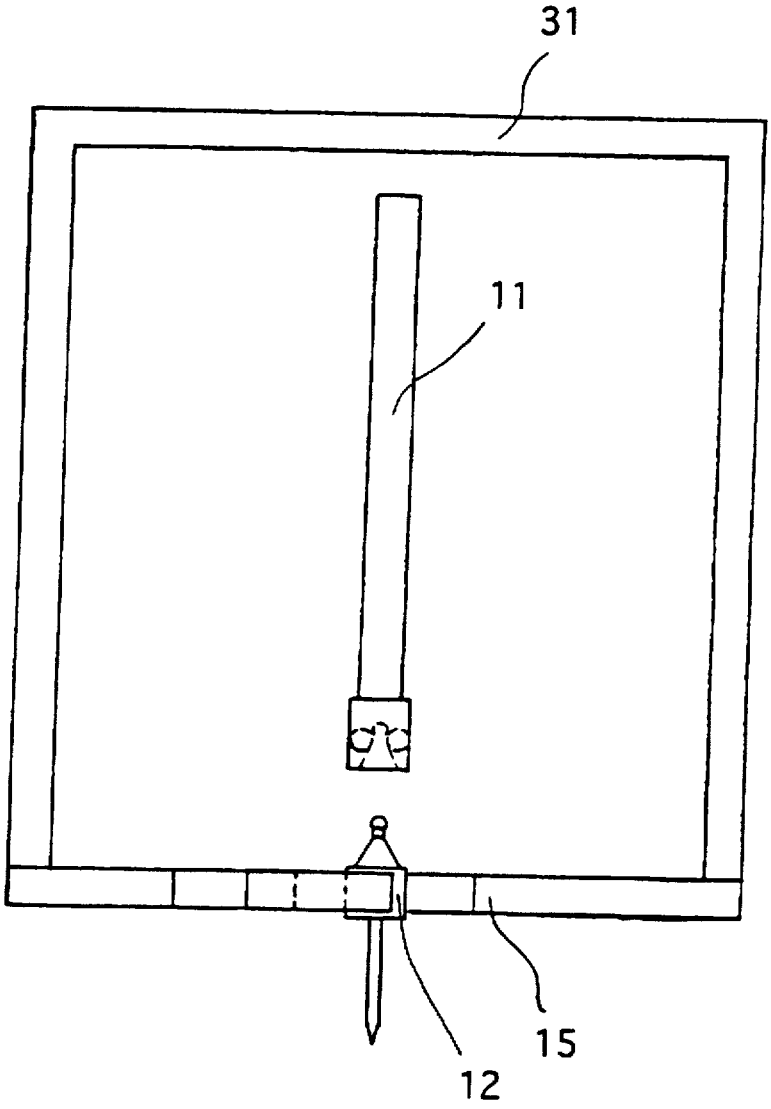
FIG. 8 is a front view illustrating exchange of the needle stud performed by the sewing machine according to the embodiment.

In a situation as shown in FIG. 8, the needle holder 15 supported by the shift frame 31 is moved and stopped in a position such that the center of the needle aligns with the center axis of the needle bar 11, by operating the shift motor 30 such as a step motor or a geared motor.

Figure 9:
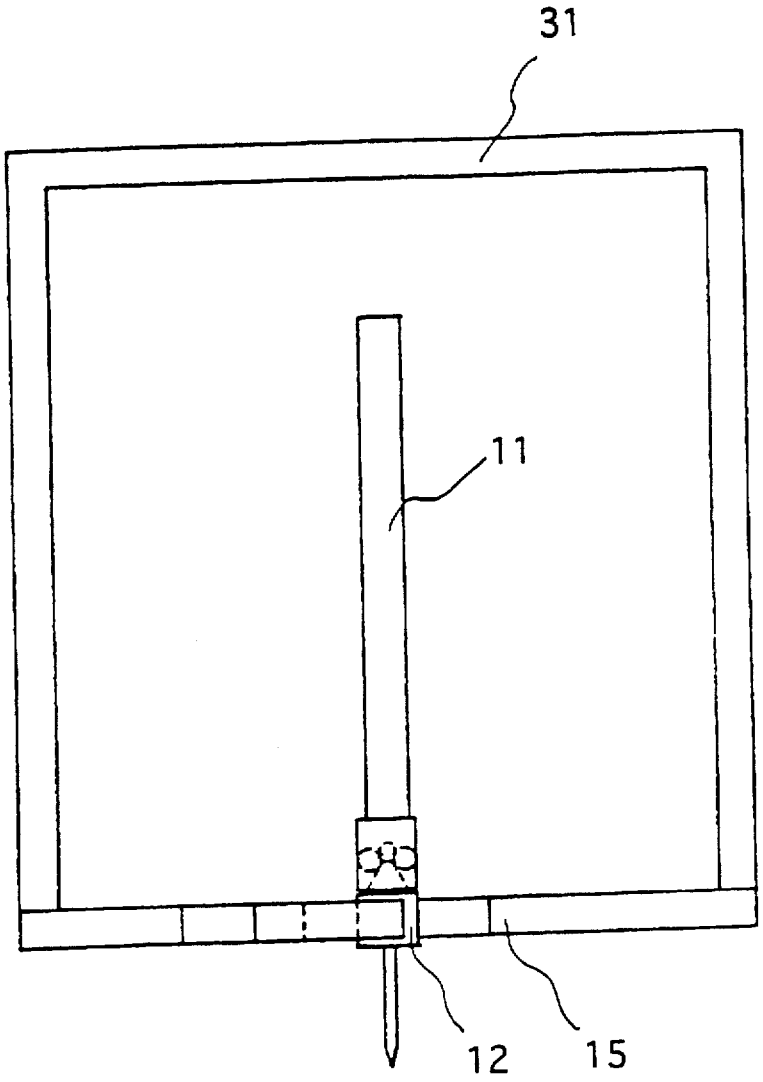
FIG. 9 is a front view illustrating exchange of the needle stud performed by the sewing machine according to the embodiment.

In a situation as shown in FIG. 9, the needle bar 11 is lowered from the position as shown in FIG. 8, upon an instruction from the controller 10, so that the needle stud 12 held by the needle holder 15 is fitted into the needle bar 11 and held by a needle stud holding spring and steel balls (not shown) that are disposed inside a lower end portion of the needle bar 11.

Figure 10:
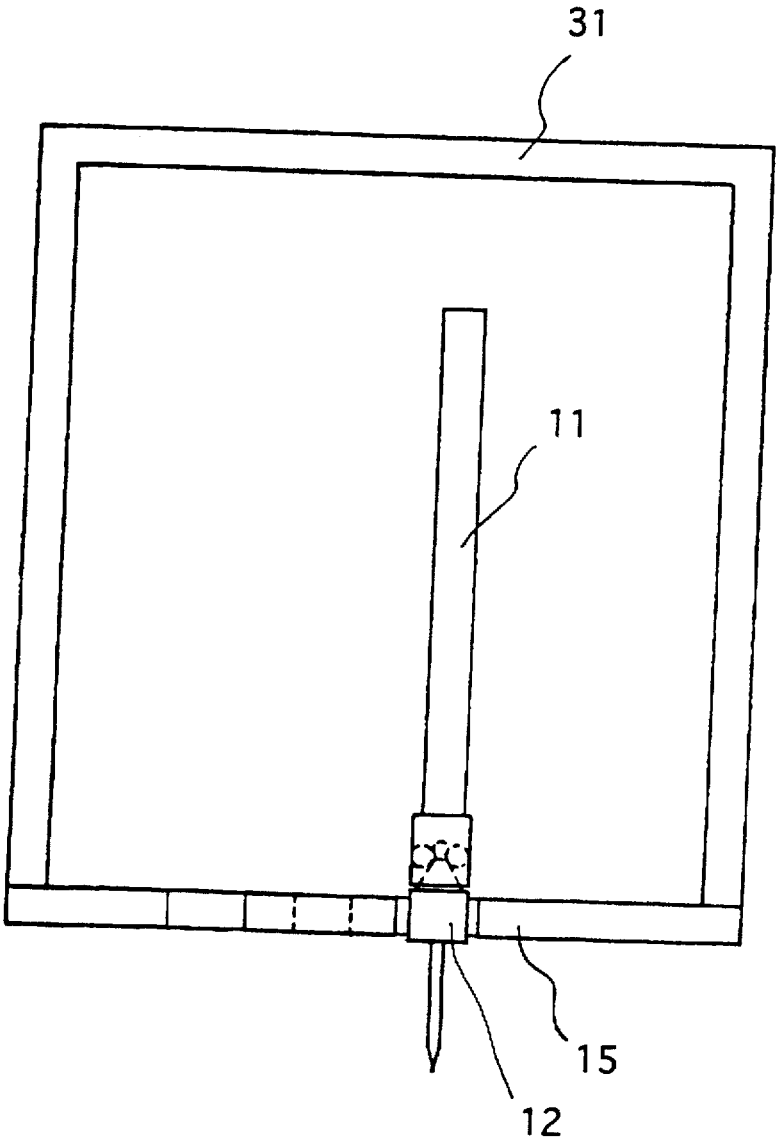
FIG. 10 is a front view illustrating exchange of the needle stud performed by the sewing machine according to the embodiment.

In a situation as shown in FIG. 10, the needle holder 15 is returned to the standby position defined for the needle exchanging operation as indicated in FIG. 7. Sewing is then performed in this positional situation. To replace the needle with another needle after sewing, the positional situation as shown in FIG. 9 is resumed.

To remove the needle used for sewing, the needle holder 15 is shifted to a needle stud fitting position as shown in FIG. 9. Thereby, the plate spring 154 is pushed down by the lower end 500 of the needle stud 12, and the pin 501 is pressed into one of the recesses 121 of the needle stud 12, so that the recesses 121 of the needle stud 12 is firmly held in the holding groove 155. Then the needle bar 11 is raised a certain amount upon an instruction from the controller 10, separating from the needle stud 12. The needle holder 15 is then returned to the standby position defined for needle exchanging operation, as shown in FIG. 7.

The shifting mechanism 2 selects a thread for sewing by operating the shift motor 30 to shift the thread barrel holder 503 disposed swingably in the shift frame 31 and the holders 32 alinged on the thread barrel holder 503, in a lateral direction with respect to the machine frame 300 of the sewing machine, to a position corresponding to the position of the holder 32 holding a thread barrel 509 holding a needle thread needed for the next sewing operation, as indicated in FIGS. 1 and 2.

The needle thread, as shown in FIG. 1, is passed through a thread pass hole 51 formed in the upper horizontal member 310 of the shift frame 31, and guided by a thread guide plate 52 disposed horizontally between the perpendicular members 311 and 312 of the shift frame 31, and held by the thread barrel 509. The needle tread further extending from the thread barrel 509 is guided again by the thread guide plate 52, and guided by another thread guide plate 53 disposed below the thread guide plate 52, and then passed through the eye of the needle.

The thread exchanging mechanism 3 performs thread exchange by one of the juxtaposed swingable holders 32 moving to the yoke 41 to receive therefrom the thread barrel 509 holding the thread used for sewing. For this operation, the holder 32 takes a position immediately under the yoke 41, and the yoke 41 swings downward to overlap the holder 32, so that the thread barrel 509 is transferred from the yoke 41 to the holder. Then, another holder 32 holding a thread barrel 509 holding a thread to be used for the next sewing moves to the yoke 41, which is currently in a non-sewing state, to pass the thread barrel 509 to the yoke 41. The holder 32 takes a position immediately under the yoke 41, and the yoke 41 swings upward to overlap the holder 32, so that the thread barrel 509 is transferred from the holder 32 to the yoke 41. The yoke 41 thus holds the new thread barrel 509.

Figure 11:
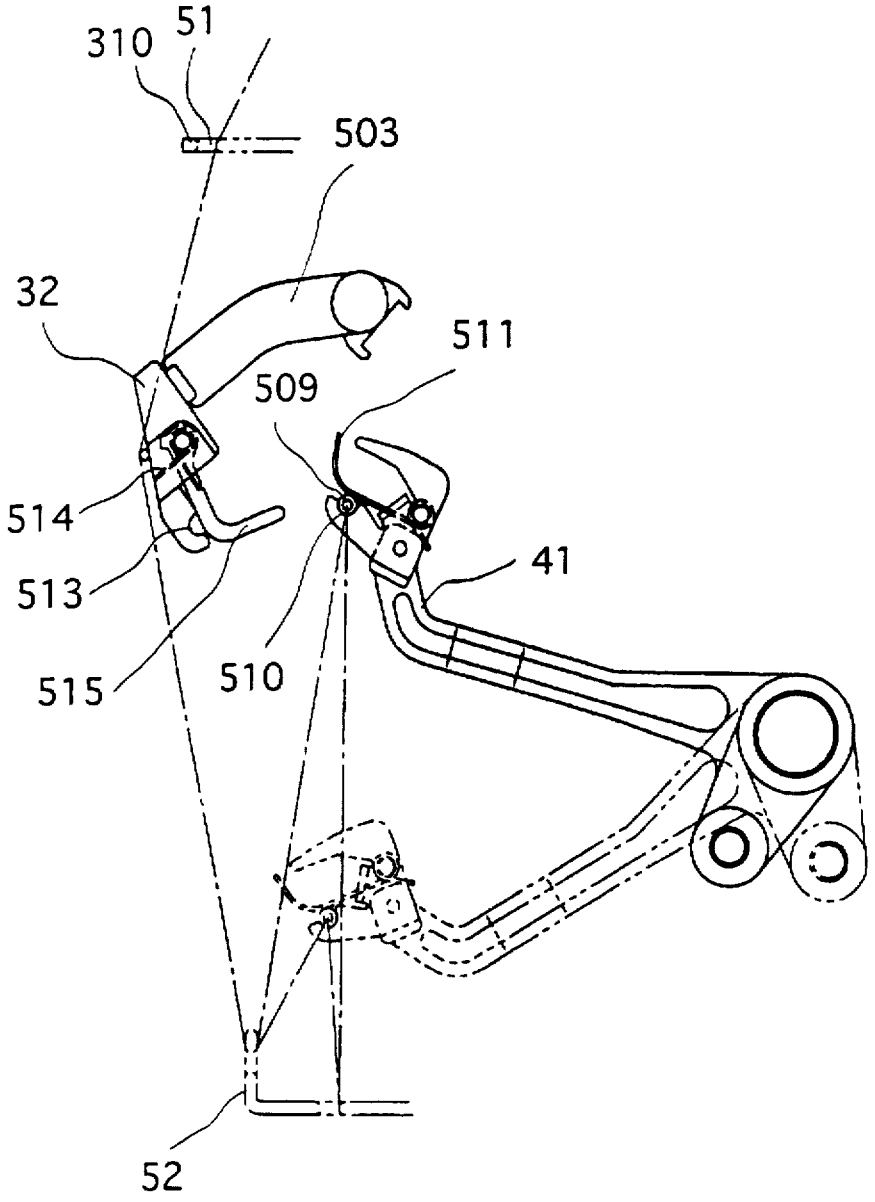
FIG. 11 is a side view of a thread exchanging mechanism when the sewing machine according to the embodiment is in a sewing state.
Figure 12:
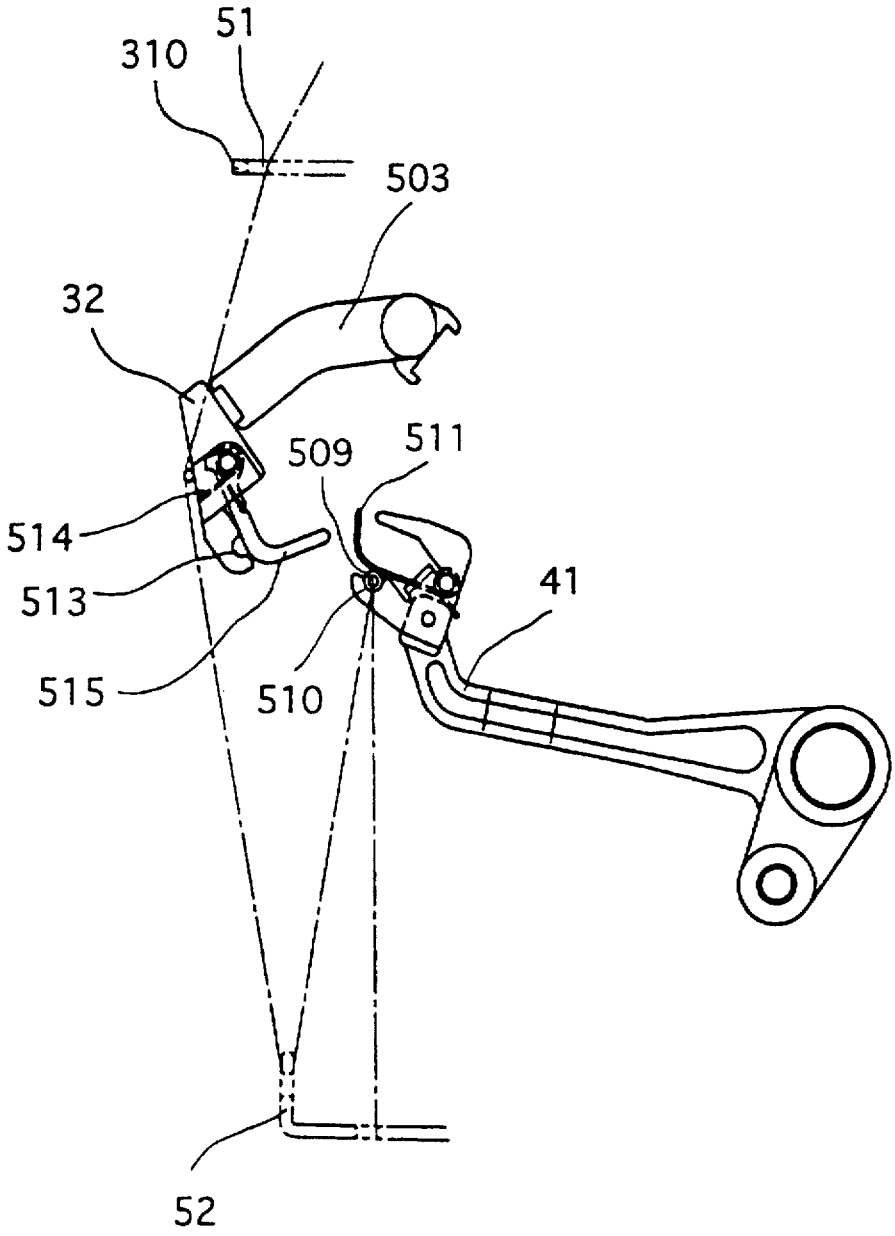
FIG. 12 is a side view of illustrating a state where a thread starts to be replaced by the sewing machine according to the embodiment.

More specifically, in a sewing state as illustrated in FIG. 11, the yoke 41 is at the top dead center (corresponding to the standby position of the needle holder 15 as shown in FIG. 10), and the holder 32 is maintained apart from the range of swing of the yoke 41, so as to avoid impeding the yoke 41 from supplying the needle thread and from tightening the thread. When the thread exchange operation starts, the yoke 41 is positioned in a thread barrel passing position, as shown in FIG. 12, upon an instruction from the controller 10.

Figure 13:
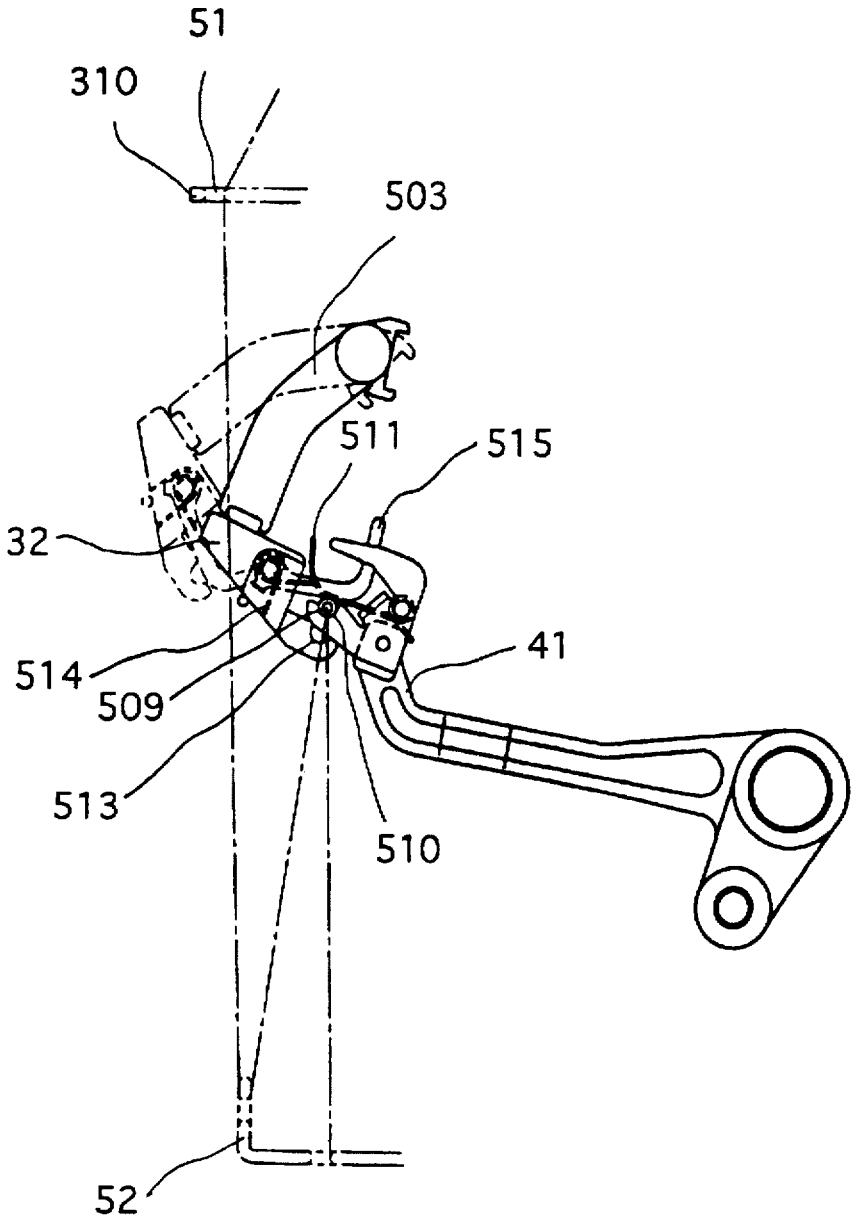
FIG. 13 is a side view illustrating a state where a yoke passes a thread barrel to a holder during thread exchange by the sewing machine according to the embodiment.

Then the holder 32 is turned counterclockwise by the operating motor 508 to a receiving position defined on a circumference that is centered at the fulcrum axis of the yoke 41 and that coincides with the center of the thread barrel 509, as shown in FIG. 13, in which the position of the holder 32 shown in FIG. 11 is indicated by two-dot lines.

In FIG. 13, the claw part 515 swingably supported on the shaft of the holder 32 abuts against outer peripheral faces of opposite end portions of the thread barrel 509 with respect to its length, during the turning movement of the holder 32 to the thread barrel receiving position. When the holder 32 comes to the thread barrel receiving position, the urged spring 514 disposed around the shaft of the holder 32 urges the thread barrel 509 clockwise (downward), thus providing the thread barrel 509 with stable support for transfer.

Figure 14:
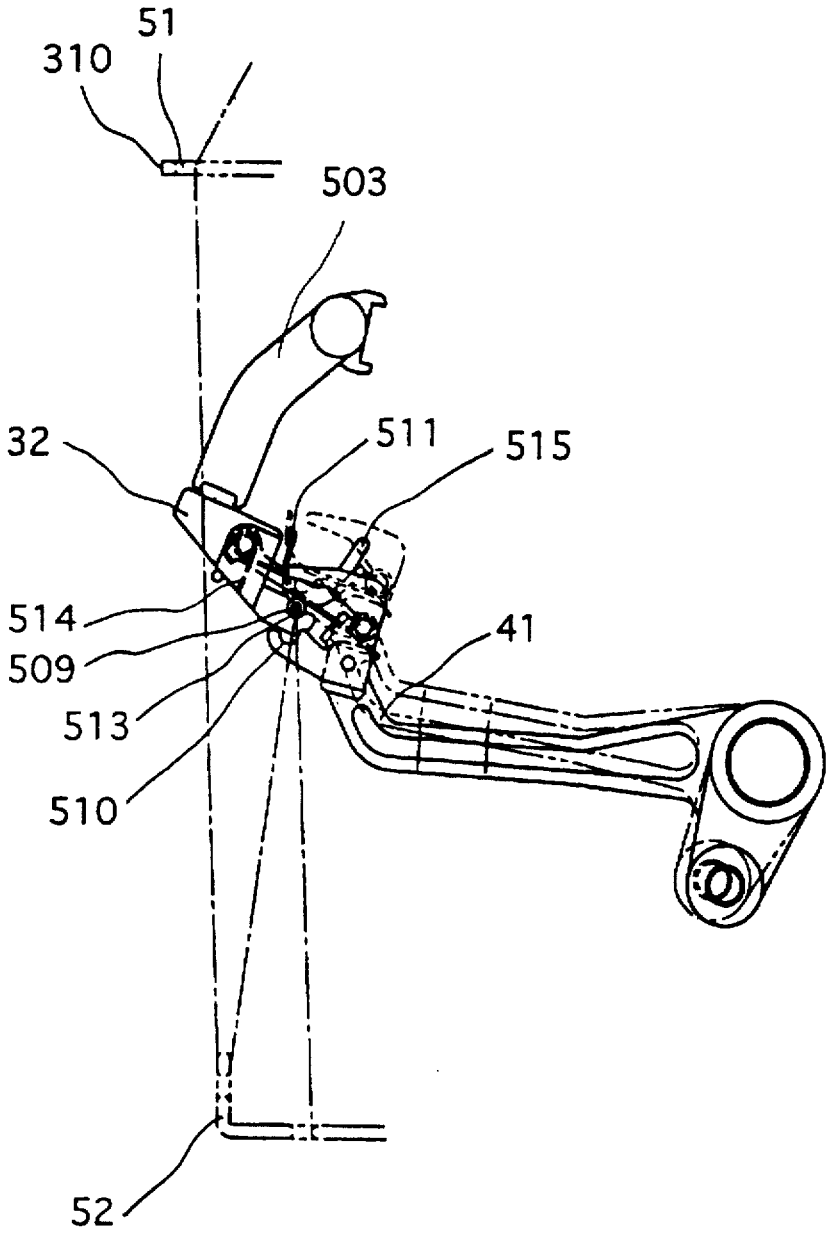
FIG. 14 is a side view illustrating a state where a yoke passes the thread barrel to the holder during thread exchange by the sewing machine according to the embodiment.

Referring to FIG. 14, where the position of the yoke 41 shown in FIG. 13 is indicated by two-dot lines, the yoke 41 turns counterclockwise (downward) upon an instruction from the controller 10. When overlapping the holder 32, the yoke 41 transfers the thread barrel 509 from the groove 510 holding the opposite end portions of the thread barrel 509 with respect to its length, to the groove 513 of the holder 32, which holds an intermediate portion of the thread barrel 509 with respect to its length. Transfer of the thread barrel 509 is thus completed.

Figure 15:
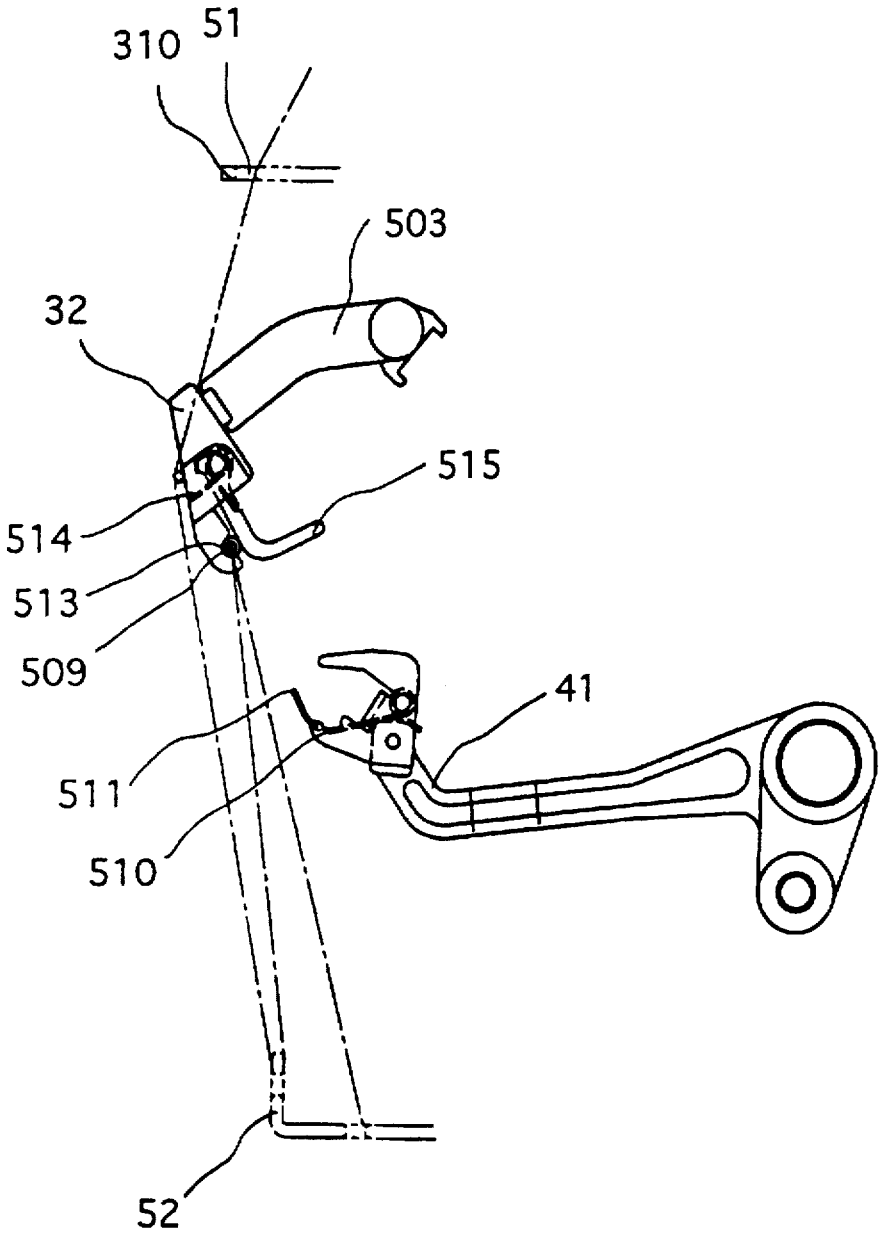
FIG. 15 is a side view illustrating a state where a thread is selected in the sewing machine according to the embodiment.

To select another needle thread for the next sewing, the holder 32 is turned counterclockwise to the standby position indicated in FIG. 11, and then the shift frame 31 is moved in a lateral direction with respect to the machine frame 300 of the sewing machine, to such a position that another holder 32 holding the thread barrel 509 holding a needle thread desired for the next sewing comes in front of the yoke 41, as shown in FIG. 15.

Figure 16:
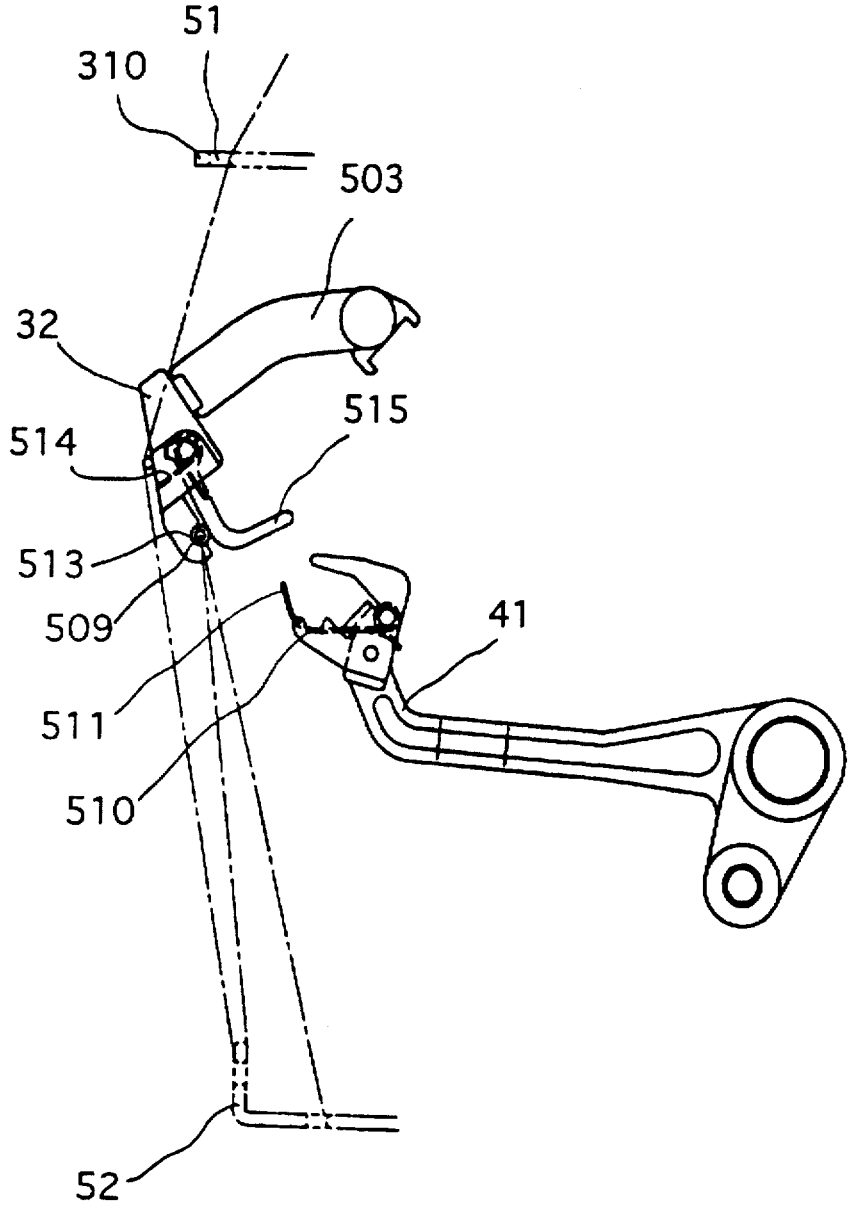
FIG. 16 is a side view illustrating a state where a selected thread starts to be passed over in the sewing machine according to the embodiment.

Referring to FIG. 16, the yoke 41 is moved to and stopped in a thread barrel receiving position, upon an instruction from the controller 10. The thread barrel receiving position of the yoke 41 is the same as the position of the yoke 41 indicated in FIG. 14.

Figure 17:
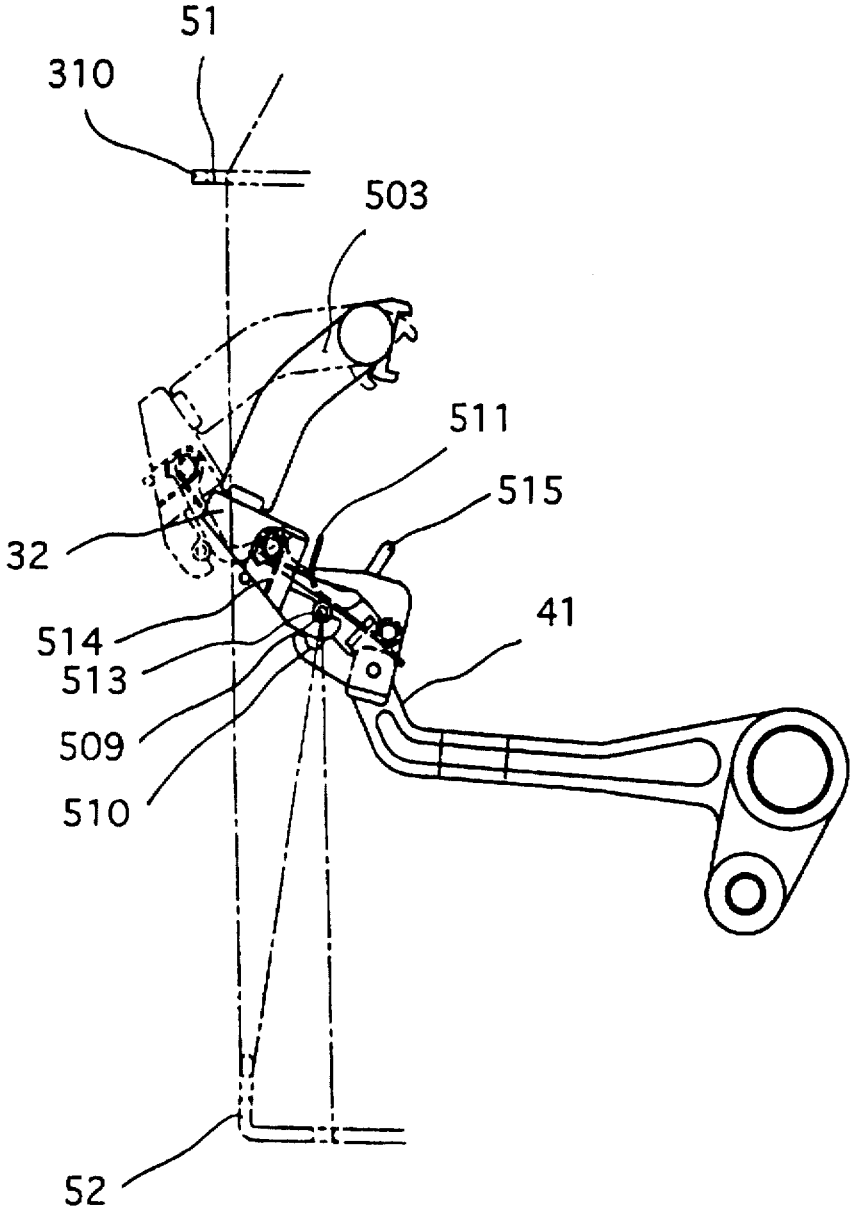
FIG. 17 is a side view illustrating a state where the holder passes a thread barrel to the yoke during thread exchange by the sewing machine according to the embodiment.

Then, as shown in FIG. 17, the holder 32 is turned counterclockwise from the standby position indicated by two-dot lines, and is stopped in a thread barrel passing position that is the same as the position of the holder 32 indicated in FIG. 13.

Further referring to FIG. 17, the press spring 511 supported on the shaft of the yoke 41 is urged clockwise. The press spring 511 abuts against outer peripheral faces of an intermediate portion of the thread barrel 509 with respect to its length during the counterclockwise turning of the holder 32. When the yoke 41 is in the thread barrel receiving position, the press spring 511 urges the thread barrel 509 counterclockwise, providing the thread barrel 509 with stable support for transfer.

Figure 18:
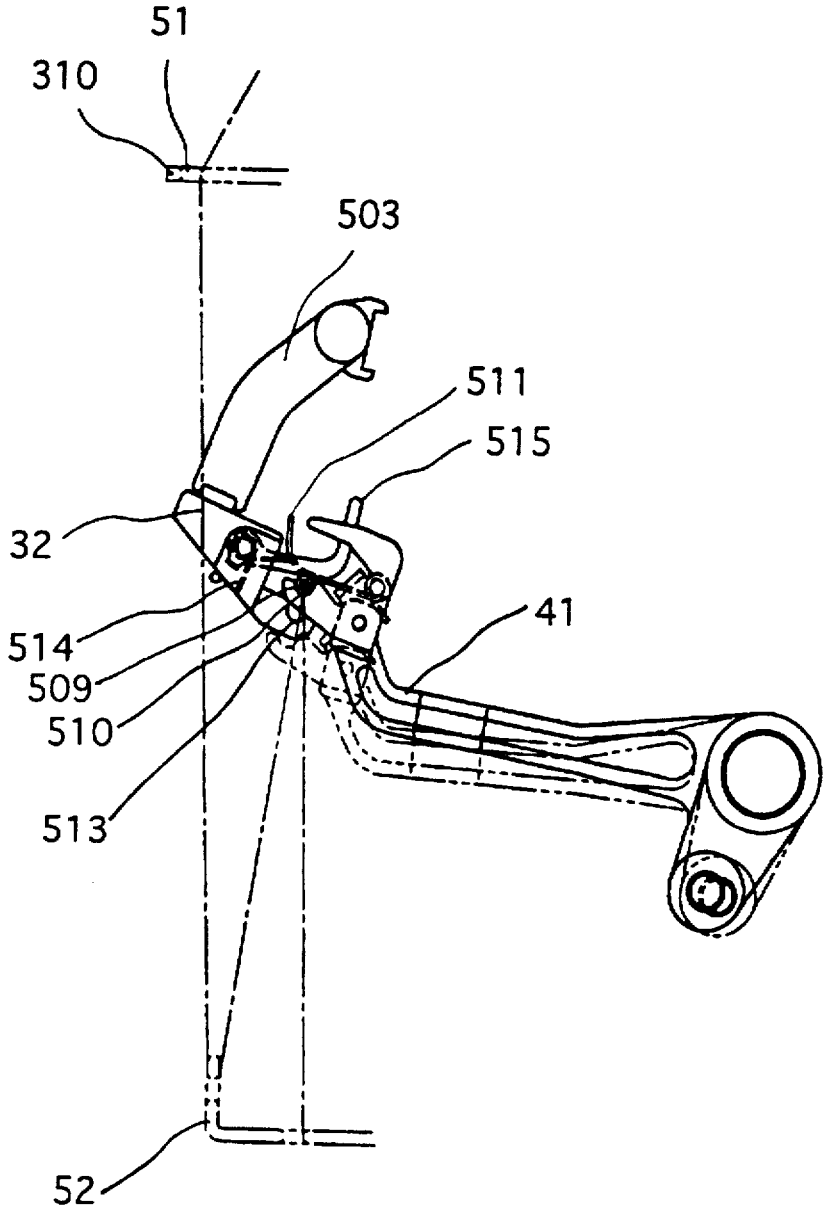
FIG. 18 is a side view illustrating a state where the holder passes a thread barrel to the yoke during thread exchange by the sewing machine according to the embodiment.

Referring to FIG. 18, where the position of the yoke 41 as shown in FIG. 17 is indicated by two-dot lines, the yoke 41 is turned clockwise (upward) upon an instruction from the controller 10. When the yoke 41 overlaps the holder 32, the thread barrel 509 transfers from the groove 513 of the holder 32 holding an intermediate portion of the thread barrel 509 with respect its length, to the groove 510, which holds opposite end portions of the thread barrel 509 with respect to its length. Thus the reception of the thread barrel 509 by the yoke 41 is completed.

Figure 19:
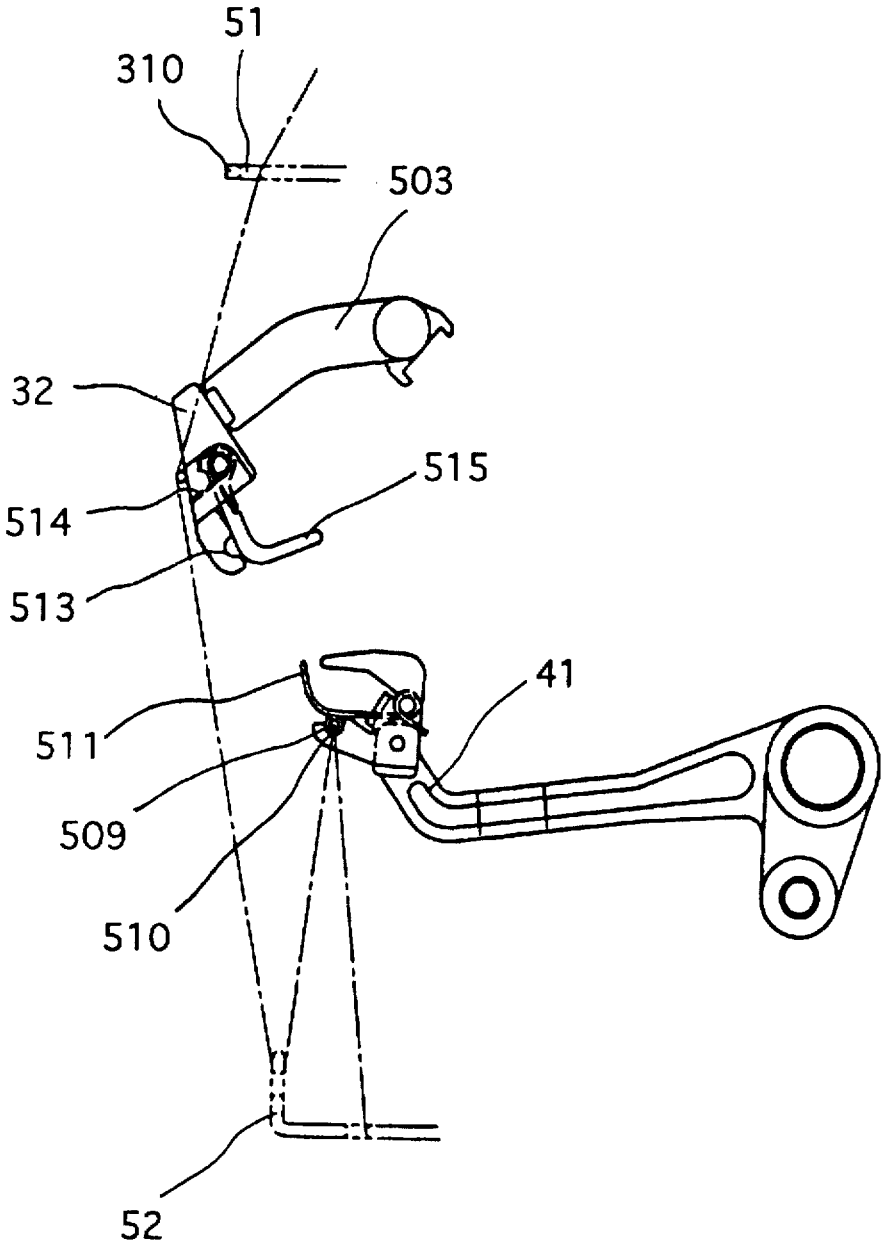
FIG. 19 is a side view illustrating a state where thread exchange is completed by the sewing machine according to the embodiment.
Figure 20:
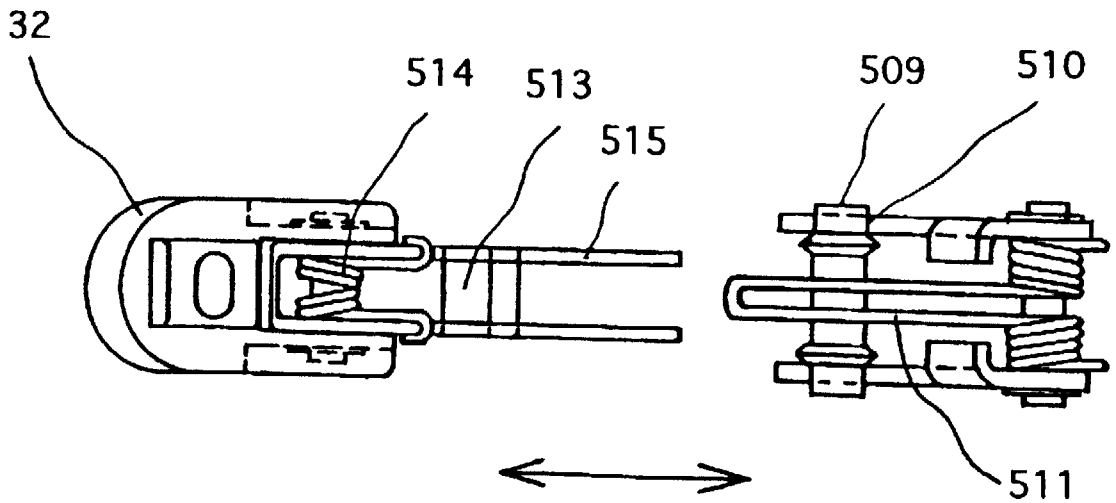
FIG. 20 is a partial top plan view illustrating the positional relation among the holder, the yoke and the thread barrel to be passed over, in the sewing machine according to the embodiment.
Figure 21:
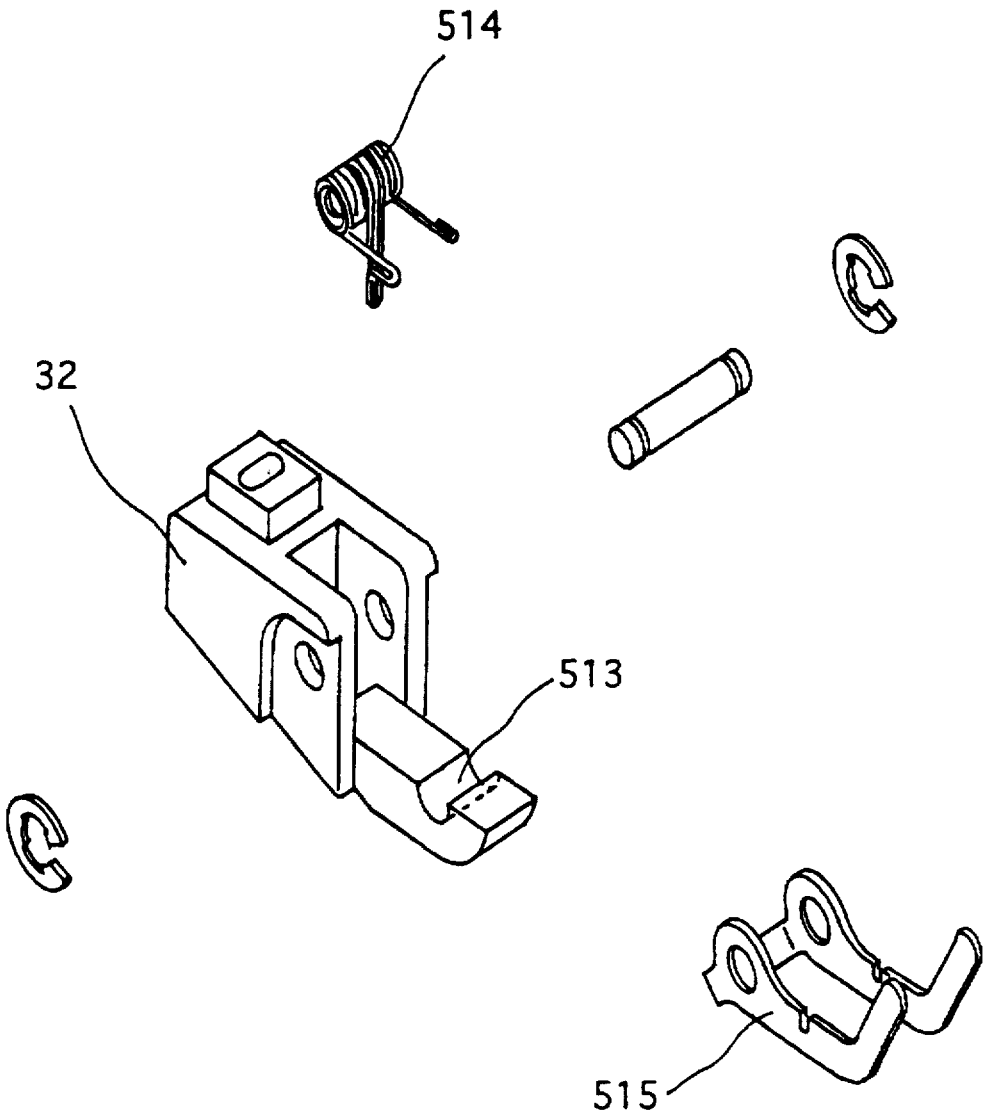
FIG. 21 is an exploded perspective view of the holder of the sewing machine according to the embodiment, illustrating a claw part.
Figure 22:
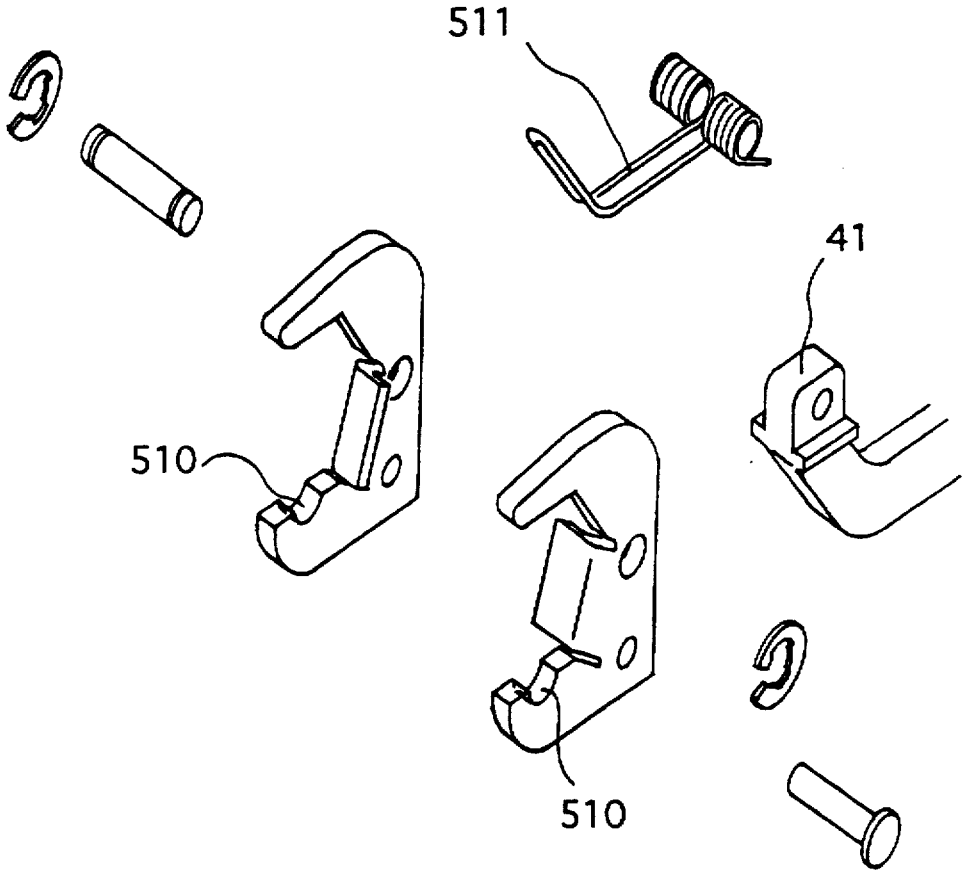
FIG. 22 is an exploded perspective view of the yoke and a presser spring of the sewing machine according to the embodiment.
Figure 23:
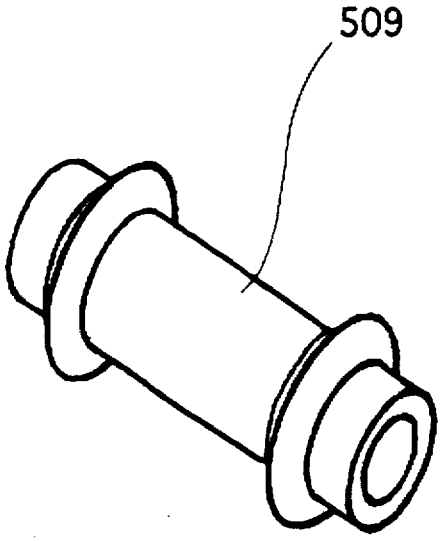
FIG. 23 is a perspective view of the thread barrel of the sewing machine according to the embodiment.
Figure 24:
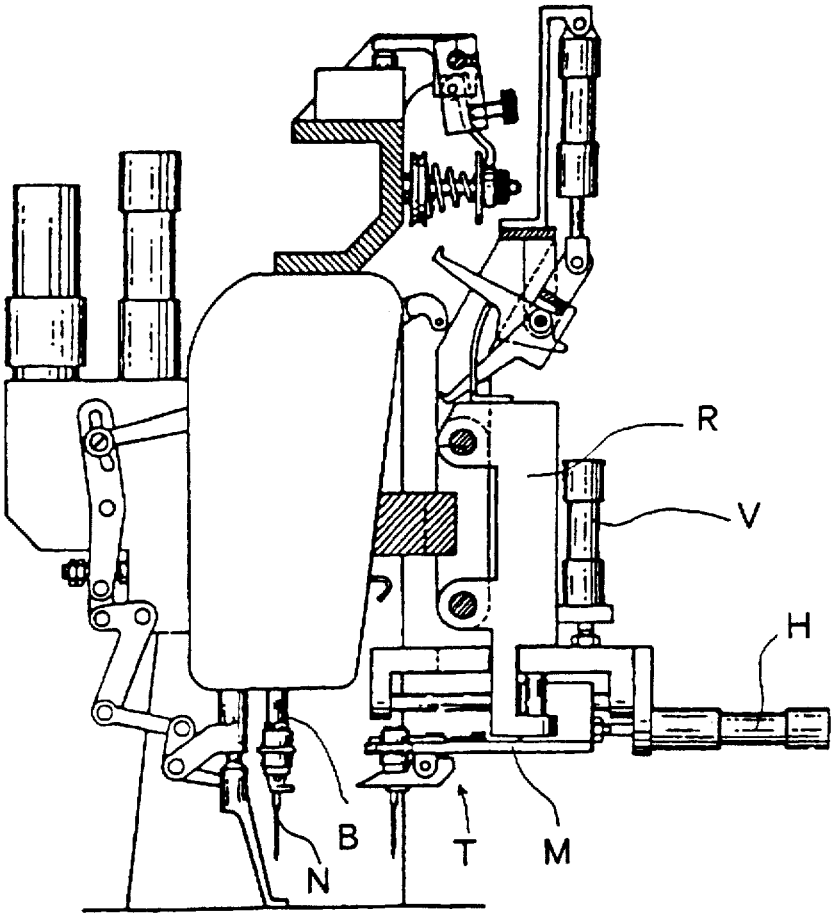
FIG. 24 (PRIOR ART)
FIG. 24 is a side view of a needle stud exchanging mechanism of a conventional sewing machine.
Figure 25:
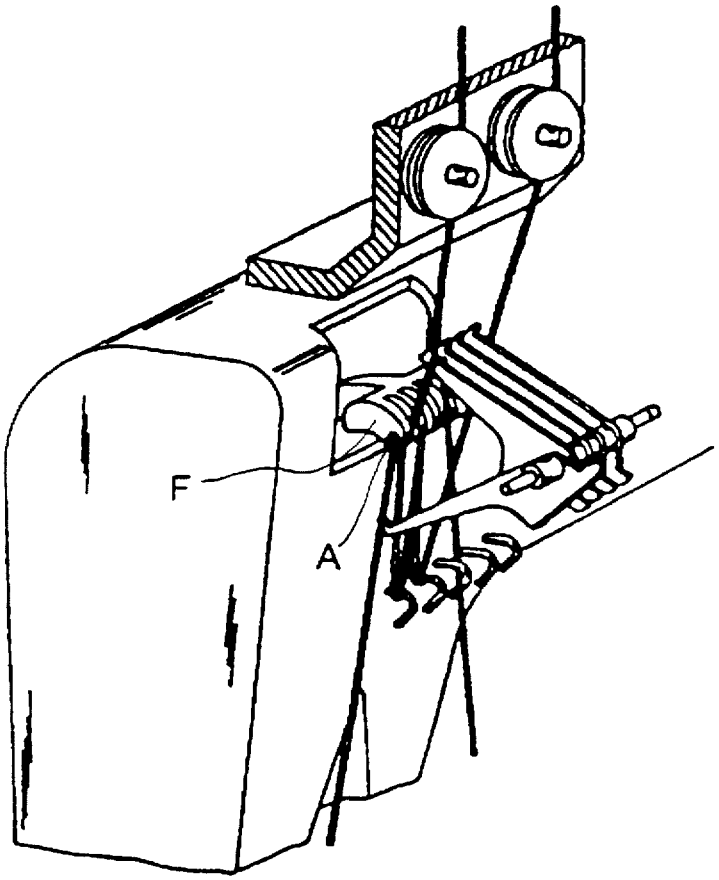
FIG. 25 (PRIOR ART)
FIG. 25 is a perspective view of a thread exchanging mechanism of the conventional sewing machine.

Then, as shown in FIG. 19, the holder 32 turns clockwise to return to the standby position indicated in FIG. 11, so as to avoid interfering with the needle thread supplying operation and the thread tightening operation of the yoke 41. The thread exchange is thus completed.

The sewing machine according to the embodiment operating as described above transfers the thread barrel 509 having a thread hole through which a thread is passed, by swinging the yoke 41, that is, the swinging member, in accordance with rotation of the main shaft motor 10, in order to perform thread exchange. Thus the sewing machine according to the embodiment facilitates reliable thread exchange.

In addition, in the sewing machine according to the embodiment, the yoke 41 provided as the first holding member holds the thread barrel 509 in the exchange position, and turns in the direction to the standby position for receiving the thread barrel 509 held in the standby position. Each holder 32 provided as a second holding member holds the thread barrel 509 in the standby position, and turns in the direction to the exchange position for passing the thread barrel 509. By exchanging the thread barrel 509 holding a thread to be replaced, the sewing machine according to the embodiment prevents a failure of thread exchange caused by directly handling a light and soft thread, thus enhancing the reliability and easiness in thread exchange.

That is, since the sewing machine according to the embodiment replaces the thread barrel 509 while the force of the springs 510, 513 is acting in a direction to the grooves 510, 513, the sewing machine according to the embodiment further ensures exchange of thread. In addition, since the force of the springs 510, 513 is acting on the thread barrel 509 so as to press it against the grooves 510, 513, the sewing machine according to the embodiment advantageously secures stable support for the thread barrel 509 for sewing, etc.

Furthermore, since the sewing machine according to the embodiment replaces the thread barrel 509 by swinging the yoke 41, that is, the first holding member, in the directions to the standby position and to the exchange position in accordance with rotations of the main motor 10 and the rotating member 13, and by swinging the holders 32, that is, the second holding members, in the directions to the exchange position and the standby position in accordance with rotation of the operating motor 508, the sewing machine according to the embodiment advantageously accomplishes well-timed and smooth thread exchange.

Further, since the sewing machine according to the embodiment selects a thread barrel holding a thread to be used for sewing, by the shift motor 30 shifting the shift frame 31 carrying the holders 32 provided as the second holding members, in a lateral direction with respect to the machine frame 300 of the sewing machine, the sewing machine according to the embodiment thus advantageously enables selection of a thread to be used for sewing.

Further, since, in the sewing machine according to the embodiment, the needle holder 15 extending laterally in a lower portion of the shift frame 31 is provided with a plurality of needle stud holding portions 155 for holding the needle studs 12 downward, corresponding to the holders 32 provided as the second holding members, it becomes advantageously possible to select the needle stud 12 connected with the thread barrel 509 holding a thread for the next sewing when that thread is selected by a lateral shift of the shift frame 31.

Furthermore, since, in the sewing machine according to the embodiment, the needle stud holding portions 155 formed by recesses arranged at fixed intervals in the direction of the length of the needle holder 15 formed of a plate member are provided with the H-shaped plate springs 154 for elastically holding the needle studs 12, the sewing machine according to the embodiment advantageously ensures the firm holding of the needle studs 12 and facilitates attachment and detachment thereof.

Further, since the sewing machine according to the embodiment removes from the needle bar 11 the needle stud to be replaced, and fits to the needle bar 11 the needle stud selected for sewing, by moving the needle bar 11 up and down along the guide 111 and shifting the needle stud holding portions 155 laterally, the embodiment advantageously accomplishes thread exchange by simple operation performed by a simple apparatus construction, and reduces the number of component parts and costs.

More specifically, the needle bar 11 is movable up and down along the guide 111 by rotation of the rotating member 13 driven by the main shaft motor 10 transmitted by the connecting road 14 one of whose end is engaged with the rotating member 13. The sewing machine replaces needles by moving the needle bar 11 upward for removal of the needle stud 12 to be replaced and moving the needle bar 11 downward for fitting the needle stud 12 to be set, thus achieving easy and reliable needle exchange.

Further, since the sewing machine according to the embodiment positions the thread barrel 509 relatively to the yoke 41 disposed on the machine frame 300 of the sewing machine, by the shift motor 30 simultaneously shifting the needle holder 14 held by the shift frame 31 for holding the needle studs 12, the thread barrel holder 504 swingably held by the shift frame 31, the plural holders 32 fixed to the thread barrel holder 503, and the thread barrels 509 held by the individual holders 32, the sewing machine enables selection of a thread for sewing, and selection between the needle stud exchange position and the needle stud standby position, using a simple mechanism.

Furthermore, since the sewing machine according to the embodiment uses the yoke 41, provided as a single first holding member, to selectively hold one of the threads held by a required number of the holders 32 provided as second holding member, the embodiment advantageously achieves a simple construction, a reduced number of component parts, easy maintenance, and a cost reduction.

Further, the sewing machine according to the embodiment replaces a needle stud 12 for needle exchange, by, upon an instruction from the controller, operating the main shaft motor 10 to move the needle bar 11 up and down, the embodiment facilitates maintenance and reduces costs simply by changing the logic of the controller without requiring expensive component parts such as air cylinders employed in conventional sewing machines.

The preferred embodiment of the present invention, as herein disclosed, is taken as an embodiment for explaining the present invention. It is to be understood that the present invention should not be restricted by this embodiment and any modifications and additions are possible so far as they are not beyond the technical idea or principle based on descriptions of the scope of the patent claims.

What is claimed is:

1. A sewing machine comprising:

a main shaft motor for driving a main shaft;

a needle bar for moving up and down by rotation of said main shaft motor;

a thread exchanging mechanism, having a swinging member swingable by rotation of said main shaft motor, for exchanging a thread by moving a thread barrel having an opening through which a thread is passed, from a standby position to an exchange position; and a controller for controlling the rotation of said main shaft motor.

2. A sewing machine according to claim 1, wherein said swinging member comprises:

a first holding member for positioning said thread barrel in the exchange position and for enabling said swinging member to swing in a direction toward the standby position; and a second holding member for positioning said thread barrel in the standby position and for enabling said swinging member to swing in a direction toward the exchange position.

3. A sewing machine according to claim 2, wherein said first holding member is connected to a rotating member driven by said main shaft motor, so that the first holding member is swung by a rotation of said main shaft motor; and said second holding member is connected to an operating motor so that said second holding member is swung by a rotation of said operating motor.

4. A sewing machine according to claim 3, wherein said second holding member comprises holders arranged at predetermined intervals on a thread barrel holder disposed swingably and horizontally between perpendicular members of said shift frame.

5. A sewing machine according to claim 4, further comprising:

a gear mechanism interposed between a gear of said thread barrel holder and said operating motor.

6. A sewing machine according to claim 3, wherein said first holding member comprises a yoke having a groove for holding a tubular thread barrel for holding a sewing thread and a spring for holding said thread barrel.

7. A sewing machine according to claim 6, wherein said second holding member comprises a plurality of holders having a groove for holding said thread barrel, a claw part for holding said thread barrel and a spring for pressing said claw part.

8. A sewing machine according to claim 6, wherein on end of said yoke is engaged with a cam groove formed on an outer peripheral wall of said rotating member driven by said main shaft motor so as to swing said yoke around a fulcrum in response to the rotation of said main shaft.

9. A sewing machine according to claim 1, further comprising a shifting mechanism including:

a shift frame movable in a lateral direction with respect to a machine frame of said sewing machine, said shift frame having a plurality of said second holding members arranged thereon in such a manner as to allow the second holding members to swing; and a shift motor for moving and positioning said shift frame relatively to said machine frame of said sewing machine.

10. A sewing machine according to claim 9, further comprising:

a needle holder disposed in a lower portion of the shift frame and extending in a lateral direction with respect to said machine frame of said sewing machine, said needle holder having a plurality of needle stud holding portions for holding needle studs formed under each of said second holding members.

11. A sewing machine according to claim 10, wherein said needle stud holding portions are formed by recesses which are arranged at a predetermined interval in a longitudinal direction of said needle holder formed by a plate member and said needle stud holding portions are provided with an arrangement of leaf springs for elastically supporting said needle studs.

12. A sewing machine according to claim 11, wherein said needle bar is movable up and down along a guide by a connecting rod one of whose ends is swingably engaged with a portion of said rotating member, so that interchange of the needle studs is enabled by upward and downward movements of said needle bar along said guide and lateral movements of said needle stud holding portions.

13. A sewing machine according to claim 12, wherein said controller controls said main shaft motor, so as to move said needle bar upward for passing said needle bar downward for fitting said needle stud to be set.

14. A sewing machine according to claim 11, wherein said needle stud holding portion comprises a H-shaped plate member having U-shaped holding grooves at both side thereof, and said leaf spring comprises a H-shaped leaf spring having a corrugated cross section attached to an lower surface of said H-shaped plate member.

15. A sewing machine according to claim 14, further comprising:

a pin and coil spring provided at each U-shaped holding groove so as to engage with a recess of said needle stud by pressing against said recess of said needle stud.

16. A sewing machine according to claim 9, further comprising:

a rack and a pinion interposed between said shift frame and said shift motor.

* * * * *